US009175593B2

(12) United States Patent
Shishido

(10) Patent No.: US 9,175,593 B2
(45) Date of Patent: Nov. 3, 2015

(54) PISTON FOR INTERNAL COMBUSTION ENGINE

(71) Applicant: Hitachi Automotive Systems, Ltd., Hitachinaka-shi, Ibaraki (JP)

(72) Inventor: Keitarou Shishido, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/204,783

(22) Filed: Mar. 11, 2014

(65) Prior Publication Data

US 2014/0283767 A1 Sep. 25, 2014

(30) Foreign Application Priority Data

Mar. 22, 2013 (JP) ..... 2013-059547

(51) Int. Cl.
*F01P 1/04* (2006.01)
*F01P 3/10* (2006.01)
*F02F 3/22* (2006.01)

(52) U.S. Cl.
CPC .... *F01P 3/10* (2013.01); *F02F 3/22* (2013.01)

(58) Field of Classification Search
CPC ..... F02F 3/003; F02F 3/00; F02F 3/02; F02F 3/18; F01P 3/10; F01P 1/04; F01P 2003/006
USPC ..... 123/41.37, 41.35, 41.44, 193.1, 193.4, 123/193.3, 193.6
See application file for complete search history.

(56) References Cited

U.S. PATENT DOCUMENTS

| | | | | |
|---|---|---|---|---|
| 6,240,828 | B1 * | 6/2001 | Fujimoto | 92/214 |
| 7,281,466 | B1 * | 10/2007 | Wilksch et al. | 92/186 |
| 2002/0046648 | A1 * | 4/2002 | Gamble | 92/159 |
| 2009/0025550 | A1 * | 1/2009 | Benz et al. | 92/186 |
| 2009/0261232 | A1 * | 10/2009 | Kollotzek | 249/175 |
| 2010/0163203 | A1 * | 7/2010 | Kollotzek | 164/369 |

FOREIGN PATENT DOCUMENTS

JP 2009-221900 A 10/2009

* cited by examiner

*Primary Examiner* — Lindsay Low
*Assistant Examiner* — Long T Tran
(74) *Attorney, Agent, or Firm* — Crowell & Moring LLP

(57) ABSTRACT

A piston for an internal combustion engine, including a crown portion that defines a combustion chamber, a ring-shaped cooling channel formed in the crown portion, through which a cooling oil flows, and a plurality of concave portions formed on at least one side of the cooling channel, in an axial direction of the piston, each of the plurality of concave portions having a curved surface.

19 Claims, 9 Drawing Sheets

PISTON FOR INTERNAL COMBUSTION ENGINE

BACKGROUND OF THE INVENTION

The present invention relates to a piston for an internal combustion engine.

Japanese Patent Application Unexamined Publication. No. 2009-221900 A recites a piston for an internal combustion engine which includes a cylindrical skirt portion, a crown portion integrally formed on an upper end of the skirt portion, and generally cylindrical pin boss portions integrally formed with the skirt portion so as to be opposed to an inner peripheral surface of the skirt portion, the in boss portions having pin insertion holes through which a piston pin extends and supporting both end portions of the piston pin. The crown portion has a thickened wall portion formed on an outer peripheral side of the crown portion along a circumferential direction thereof. The thickened wall portion has a generally ring-shaped cooling channel therein which is a cooling passage for allowing such a cooling medium as a lubricating oil to flow through and cool the crown portion. Further, an introduction hole and a drain hole are formed at a lower end of the thickened wall portion and opened into the cooling channel.

Introduced from the introduction hole into the cooling channel is a lubricating oil injected from an oil jet disposed on a cylinder block in the vicinity of a bottom dead center position of the piston. The lubricating oil flows through the cooling channel, and then is discharged from the drain hole. By thus flowing the lubricating oil in the cooling channel, heat in the piston is absorbed by the lubricating oil so that the piston can be cooled.

Further, when changeover of acceleration of the piston in an up-and-down direction occurs in accordance with up-and-down movement of the piston, the lubricating oil in the cooling channel causes interference along an inner peripheral surface of the cooling channel to splash on the inner peripheral surface of the cooling channel. As a result, the lubricating oil is contacted with the whole inner peripheral surface of the cooling channel, thereby enhancing an efficiency of absorption of heat in the piston.

SUMMARY OF THE INVENTION

However, in the piston of the above related art, when changeover of acceleration of the piston in an up-and-down direction occurs in accordance with up-and-down movement, of the piston, the lubricating oil in the cooling channel is difficult to cause interference, and flow along the inner peripheral surface of the cooling channel. Therefore, there is a fear that a flow rate of the lubricating oil is reduced to thereby cause a drop in cooling performance.

The present invention was made in consideration of the above circumstances of the piston of the related art. An object of the present invention is to provide a piston including a cooling channel that has a plurality of spherical concave portions formed in an inner peripheral surface of the cooling channel, thereby enhancing cooling performance.

The other objects and features of this invention will become understood from the following description with reference to the accompanying drawings.

In a first aspect of the present invention, there is provided a piston for an internal combustion engine, including:

a crown portion that defines a combustion chamber;

a ring-shaped cooling channel formed in the crown portion, through which a cooling oil flows; and a plurality of concave portions formed on at least one side of the cooling channel in an axial direction of the piston, each of the plurality of concave portions having a curved surface.

With this construction, a cooling performance of the piston can be enhanced.

In a second aspect of the present invention, there is provided the piston according to the first aspect, wherein the plurality of concave portions are formed on both an inner peripheral side and an outer peripheral side of each of an upper end surface and a lower end surface of the cooling channel which are opposed to each other in a direction parallel to the axial direction of the piston.

With this construction, a cooling performance of the piston can be enhanced by a turning flow of the cooling oil generated in the concave portions during both an upward movement and a downward movement of the piston.

In a third aspect of the present invention, there is provided the piston according to the second aspect, wherein the plurality of concave portions are opposed to each other in the direction parallel to the axial direction of the piston.

In a fourth aspect of the present invention, there is provided the piston according to the first aspect, wherein the plurality of concave portions are formed in an upper end surface and a lower end surface of the cooling channel which are opposed to each other in a direction parallel to the axial direction of the piston.

In a fifth aspect of the present invention, there is provided the piston according to the first aspect, wherein the plurality of concave portions are formed in a radial direction of the cooling channel.

With this construction, portions of the cooling channel in which the lubricating oil flows and turns around can be increased. As a result, the flow rate of the cooling oil flowing in the cooling channel, can be increased, so that an efficiency of heat exchange and a cooling performance of the piston can be enhanced.

In a sixth aspect of the present invention, there is provided the piston according to the fifth aspect, wherein the plurality of concave portions are formed in a substantially equidistantly spaced relation to each other in a circumferential direction of the cooling channel.

With this construction, portions of the cooling channel in which the lubricating oil flows and turns around can be increased, so that a cooling performance of the piston can be enhanced.

In a seventh aspect of the present invention, there is provided the piston according to the first aspect, wherein the plurality of concave portions are formed in such a position as inclined with respect to a horizontal plane extending through an upper-most portion or a lower-most portion of the cooling channel.

With this construction, it is possible to suppress increase in whole height of the cooling channel and therefore, enhance a freedom of layout of the cooling channel in the crown portion of the piston.

In an eighth aspect of the present invention, there is provided the piston according to the first aspect, wherein the ring shape of the cooling channel is partly interrupted in a circumferential direction thereof.

In a ninth aspect of the present invention, there is provided the piston according to the first aspect, wherein the cooling channel has an oval shape in sectional view which has a major axis extending in a direction parallel to the axial direction of the piston.

In a tenth aspect of the present invention, there is provided the piston according to the first aspect, wherein the cooling channel has a rectangular shape with rounded corners.

In an eleventh aspect of the present invention, there is provided the piston according to the first aspect, wherein the piston is a cast piston made of an aluminum alloy material.

In a twelfth aspect of the present invention, there is provided the piston according to the eleventh aspect, wherein the cooling channel is formed by dissolving a soluble core after casting the piston subsequent to setting the soluble core in a forming die.

In a thirteenth aspect of the present invention, there is provided the piston according to the twelfth aspect, wherein the soluble core is made of a sodium chloride material.

With this construction, the soluble core can be dissolved by injecting water into an introduction hole and a drain hole which are opened into the cooling channel by using a core dissolving jig after casting of the piston. As a result, the production of the piston can be facilitated.

In a fourteenth aspect of the present invention, there is provided the piston according to the thirteenth aspect, wherein the soluble core is formed by a compression press.

Accordingly, the formation work of the soluble core can be facilitated.

In a fifteenth aspect of the present invention, there is provided a piston for an internal combustion engine, including:

a crown portion that defines a combustion chamber;

a ring-shaped cooling channel, formed in the crown portion, through which a cooling oil flows; and a plurality of concave portions formed on at least one side of the cooling channel in an axial direction of the piston, each of the plurality of concave portions having a semi-spherical surface.

In a sixteenth aspect of the present invention, there is provided a piston for an internal combustion engine, including:

a crown portion that defines a combustion chamber; and a ring-shaped cooling channel formed in the crown portion, through which a cooling oil flows, the cooling channel including a plurality of concave portions formed on at least one side in an axial direction of the piston;

wherein each of the plurality of concave portions has a concave shape configured such that the cooling oil is allowed to flow and turn around in multiple directions in the concave portion in accordance with an axial movement of the piston.

In a seventeenth aspect of the present invention, there is provided the piston according to the sixteenth aspect, wherein each of the plurality of concave portions has a rectangular shape with rounded corners.

In an eighteenth aspect of the present invention, there is provided the piston according to the sixteenth aspect, wherein each of the plurality of concave portions has an oval shape.

In a nineteenth aspect of the present invention, there is provided the piston according to the eighteenth aspect, wherein the oval shape of each of the plurality of concave portions has a major axis extending along a circumferential direction of the cooling channel.

DETAILED DESCRIPTION OF THE INVENTION

In the following, pistons for an internal combustion engine according to embodiments of the present invention are explained in detail by referring to the accompanying drawings. The piston according to each of the embodiments is applicable to a reciprocating gasoline engine.

First Embodiment

Figure 1:
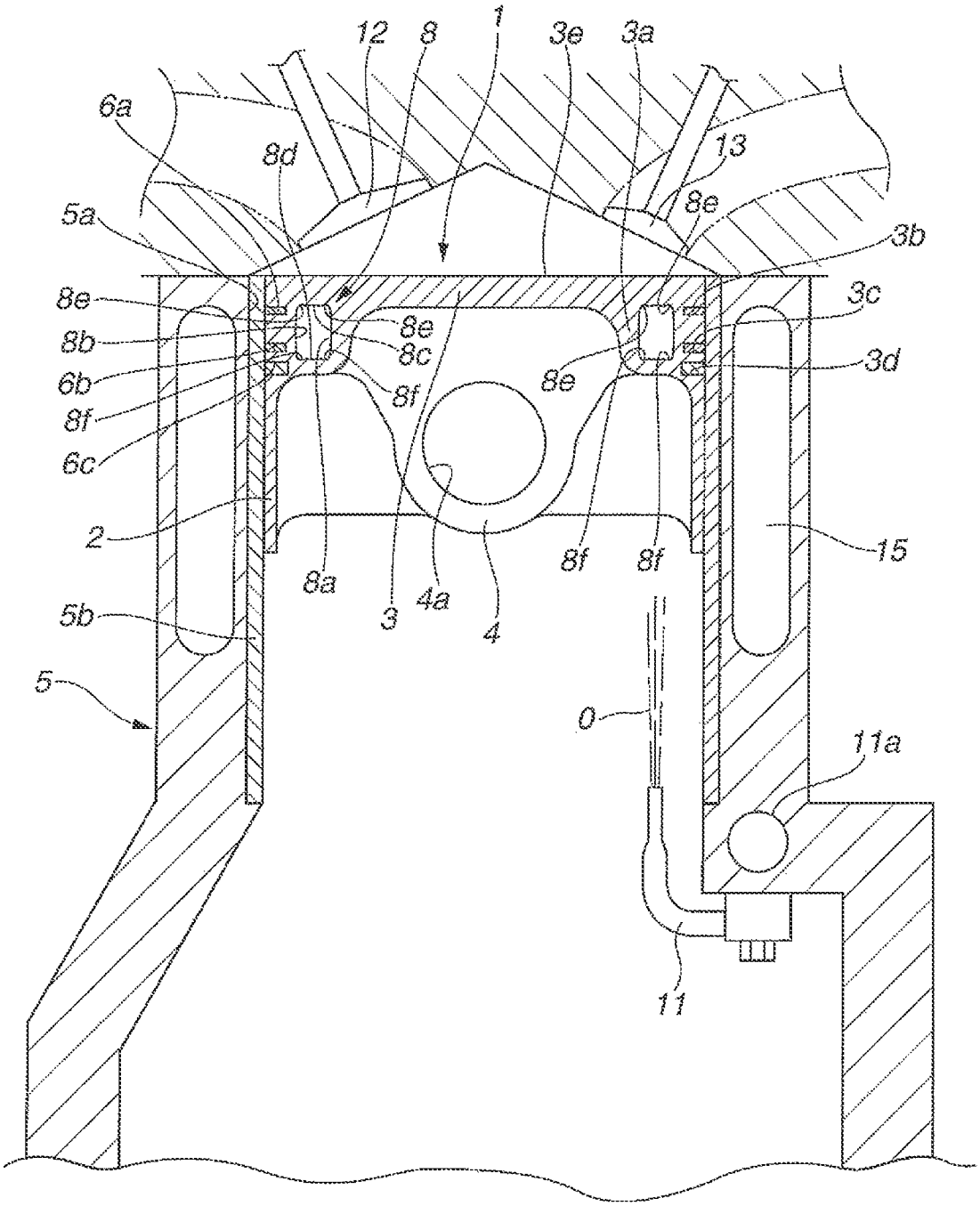
FIG. 1 is a longitudinal sectional view of a piston for an internal combustion engine according to a first embodiment of the present invention.
Figure 2:
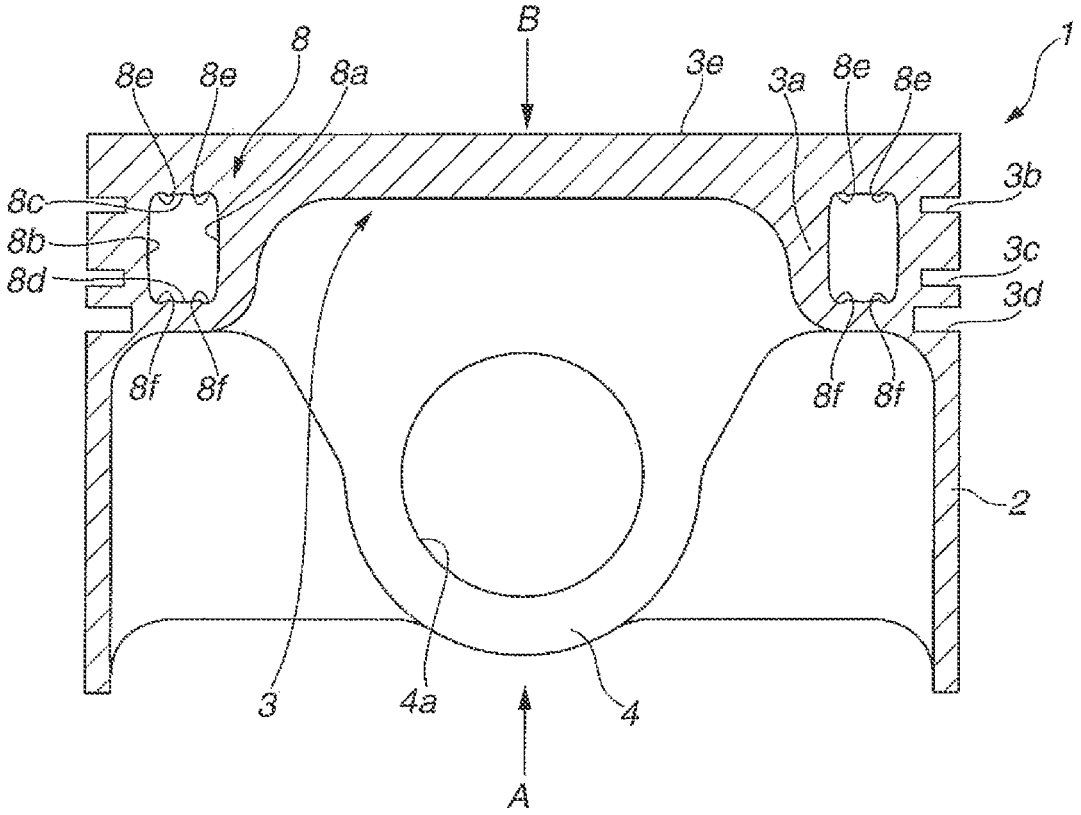
FIG. 2 is an enlarged view of the piston shown in FIG. 1.
Figure 3:
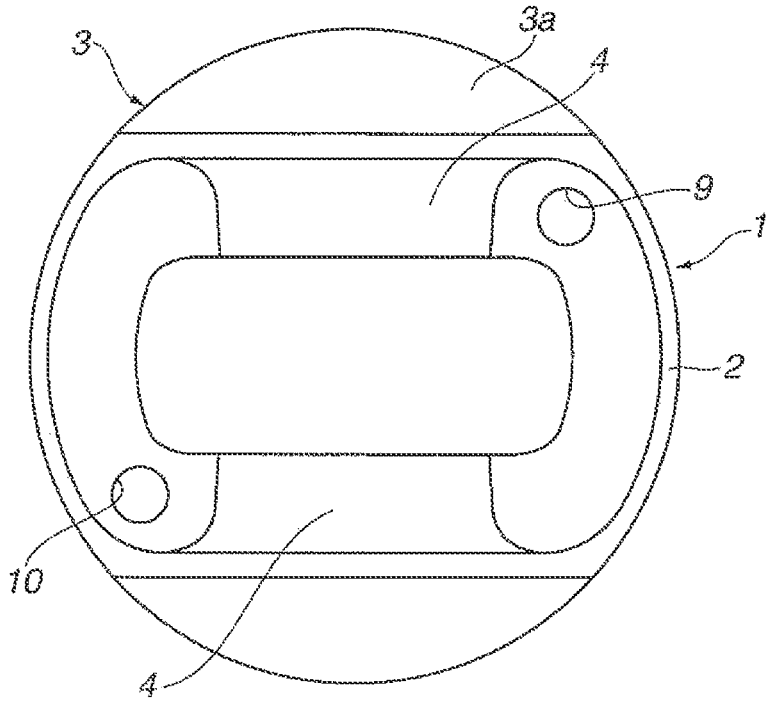
FIG. 3 is a plan view taken in a direction of arrow A shown in FIG. 2.

FIG. 1 to FIG. 3 show piston 1 according to a first embodiment of the present invention. Piston 1 is formed by casting an aluminum alloy material. As shown in FIG. 1 to FIG. 3, piston 1 includes cylindrical, skirt portion 2, crown portion 3 integrally formed on an upper end of skirt portion 2, two pin boss portions 1 integrally formed on a side wall of skirt portion 2 in an opposed relation to each other. Pin boss portions 4 have a generally cylindrical shape as shown in FIG. 1. Pin boss portions 4 have pin insertion holes 4*a* through which a piston pin (not shown) extends, and support both end portions of the piston pin. Piston 1 is slidably disposed in tubular cylinder liner 5*b* press-fitted or inserted into cylinder 5*a* of cylinder block 5 of the engine. Water jacket 15 is formed in cylinder block 5, through which a cooling water flows along cylinder 5*a*.

As shown in FIG. 1 to FIG. 3, crown portion 3 includes thickened wall portion 3*a* formed on an outer peripheral side of crown portion 3 along a circumferential direction of crown portion 3. Thickened wall portion 3*a* has three annular grooves 3*b*-3*d* formed on an outer peripheral side surface of thickened wall portion 3*a* at predetermined intervals in an axial direction of piston 1. Thee piston rings 6*a*-6*c* are fitted into annular grooves 3*b*-3*d*. Further, thickened wall portion 3*a* has generally ring-shaped cooling channel 8 therein. Cooling channel 8 is a cooling passage through which lubricating oil (cooling oil) O flows to thereby cool piston 1.

Figure 4:
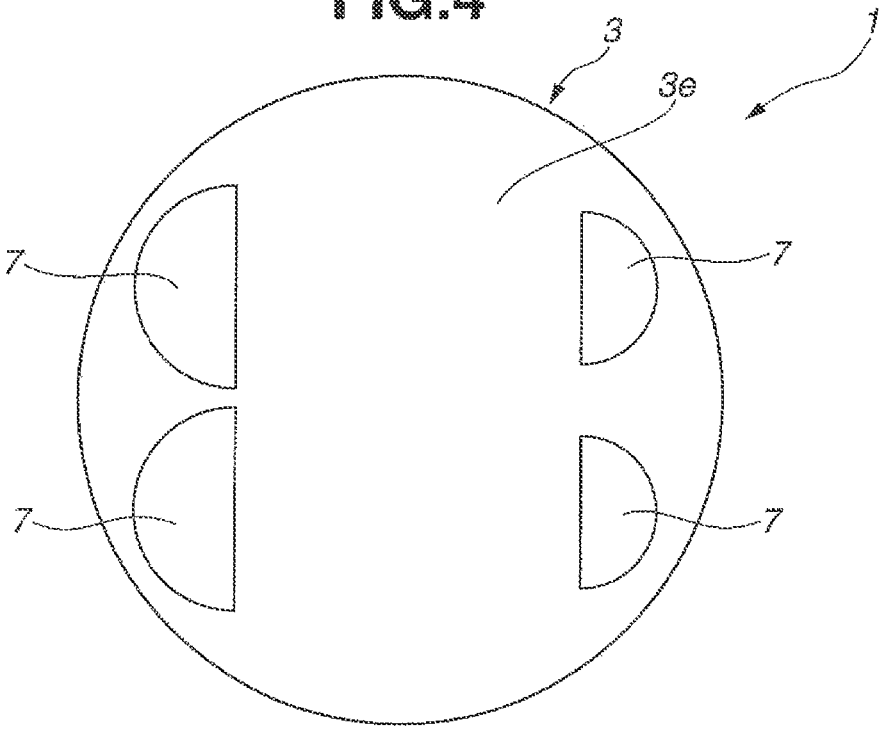
FIG. 4 is a plan view taken in a direction of arrow B shown in FIG. 2.
Figure 5:
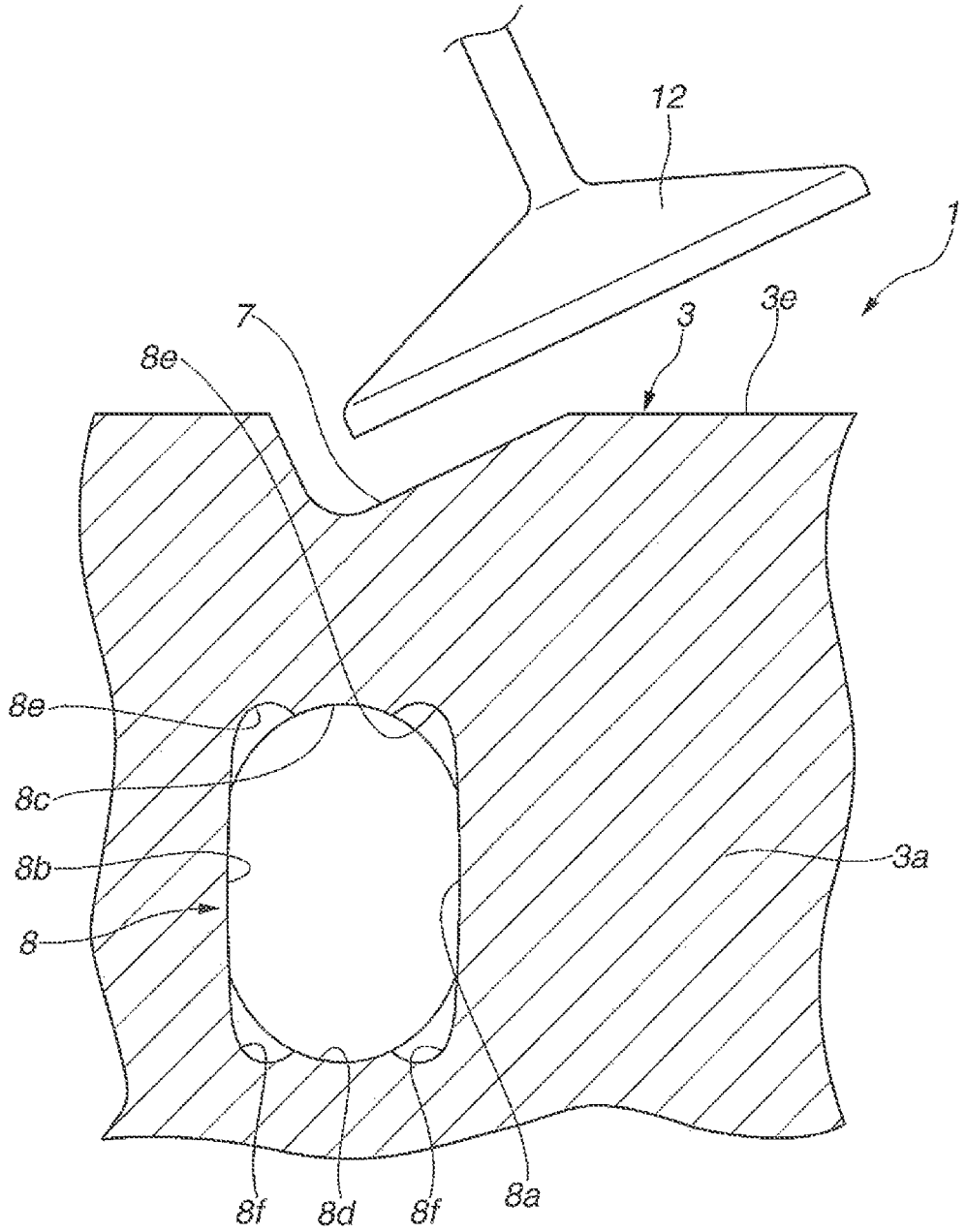
FIG. 5 is a sectional view of an essential part of the piston shown in FIG. 1.

As shown in FIG. 4 and FIG. 5, crown portion 3 also has four valve recesses 7 on upper surface (crown surface) 3*e* thereof. Valve recesses 7 are provided in order to prevent interference between crown surface 3*e* and intake valve 12 and exhaust valve 13 which constitute a part of a valve operating mechanism. Each of valve recesses 7 has a generally semicircular shape as shown in FIG. 4, and is formed to have such a preset depth that serves to prevent crown surface 3*e* from interfering with intake and exhaust valves 12, 13. With the provision of valve recesses 7, intake and exhaust valves 12, 13 can be protected from suffering damages due to interference with crown surface 3*e*. In addition, valve recesses 7 are formed to have a distance from cooling channel 8 which serves to ensure a strength of thickened wall portion 3*a*.

Further, the number of valve recesses 7 may be merely two for either one of the intake side and the exhaust side.

As shown in FIG. 3, introduction hole 9 and drain hole 10 are formed in an inner surface (lower surface) of thickened wall portion 3*a*. Introduction hole 9 and drain hole 10 are opened into cooling channel 8. As shown in FIG. 1, oil jet 11 is disposed on a lower end of the exhaust side of cylinder 5*a*, and oil passage 11*a* is formed in a lower end portion of cylinder 5*a*, through which lubricating oil O flows into oil jet 11. The lubricating oil O is injected from oil jet 11 toward introduction hole 9. The lubricating oil O injected from oil jet 11 is introduced into cooling channel 8 through introduction hole 9, and flows in cooling channel 8 to more to drain hole 10, and is discharged downward therethrough. Thus, a one-way flow of the lubricating oil O in one direction is allowed. Further, the lubricating oil O discharged from cooling channel 8 through drain hole 10 is circulated through the engine.

As shown in FIG. 1, FIG. 2 and FIG. 5, ring-shaped cooling channel 8 has an oval shape in sectional view which is elongated in an up-and-down direction (i.e., in a direction parallel to the axial direction of piston 1). Cooling channel 8 includes a pair of inner and outer peripheral side surfaces 8*a*, 8*b* which are opposed to each other in a radial direction of cooling channel 8 (i.e., in a radial direction of piston 1), and a pair of partly cylindrical upper and lower end surfaces 8*c*, 8*d* which are opposed to each other in an axial direction of cooling channel 8 (i.e., in the axial direction of piston 1).

A plurality of concave portions each having a curved surface are formed on at least one side of cooling channel 8 in the axial direction of piston 1. Each of the plurality of concave portions has a concave shape configured such that the lubricating oil O is allowed to turn and flow in multiple directions in the concave portion in accordance with the axial movement of piston 1 (the upward movement and the downward movement of piston 1). In this embodiment, a plurality of concave portions 8*e* and a plurality of concave portions 8*f* are formed on an upper side and a lower side of cooling channel 8 in the axial direction of piston 1, respectively. Specifically, concave portions 8*e* are formed on an inner peripheral, side and an outer peripheral side of upper end surface 8*c*. Concave portions 8*f* are formed on an inner peripheral, side and an outer peripheral side of lower end surface 8*d*. Concave portions 8*e* and concave portions 8*f* are arranged in an opposed relation to each other in the axial direction of piston 1 (in the up-and-down direction). Each of concave portions 8*e*, 8*f* has a semispherical shape. Concave portions 8*e* are arranged in a substantially equidistantly spaced relation to each other in a circumferential direction of cooling channel 8 and in an opposed relation to each other in a radial direction of cooling channel 8. Similarly, concave portions 8*f* are arranged in a substantially equidistantly spaced relation to each other in the circumferential direction of cooling channel 8 and in an opposed relation to each other in the radial direction of cooling channel 8. Further, each of concave portions 8*e* has such a depth that a bottom of concave portion 8*e* is located in the same position as a position of an upper-most portion of upper end surface 8*c* in the up-and-down direction. Each of concave portions 8*f* also has such a depth that a bottom of concave portion 8*f* is located in the same position as a position of a lower-most portion of lower end surface 8*d* in the up-and-down direction. In other words, the depth of each of concave portions 8*e*, 8*f* is set such that a distance between concave portions 8*e* opposed to each other in the up-and-down direction and a distance between concave portions 8*f* opposed to each other in the up-and-down direction are substantially equal to a whole height of cooling channel 8 in the up-and-down direction. Meanwhile, the depth of each of concave portions 8*e*, 8*f* can be set such that the distance between concave portions 8*e* opposed to each other in the up-and-down direction and the distance between concave portions 8*f* opposed to each other in the up-and-down direction are smaller than the whole height of cooling channel 8.

Figure 6:
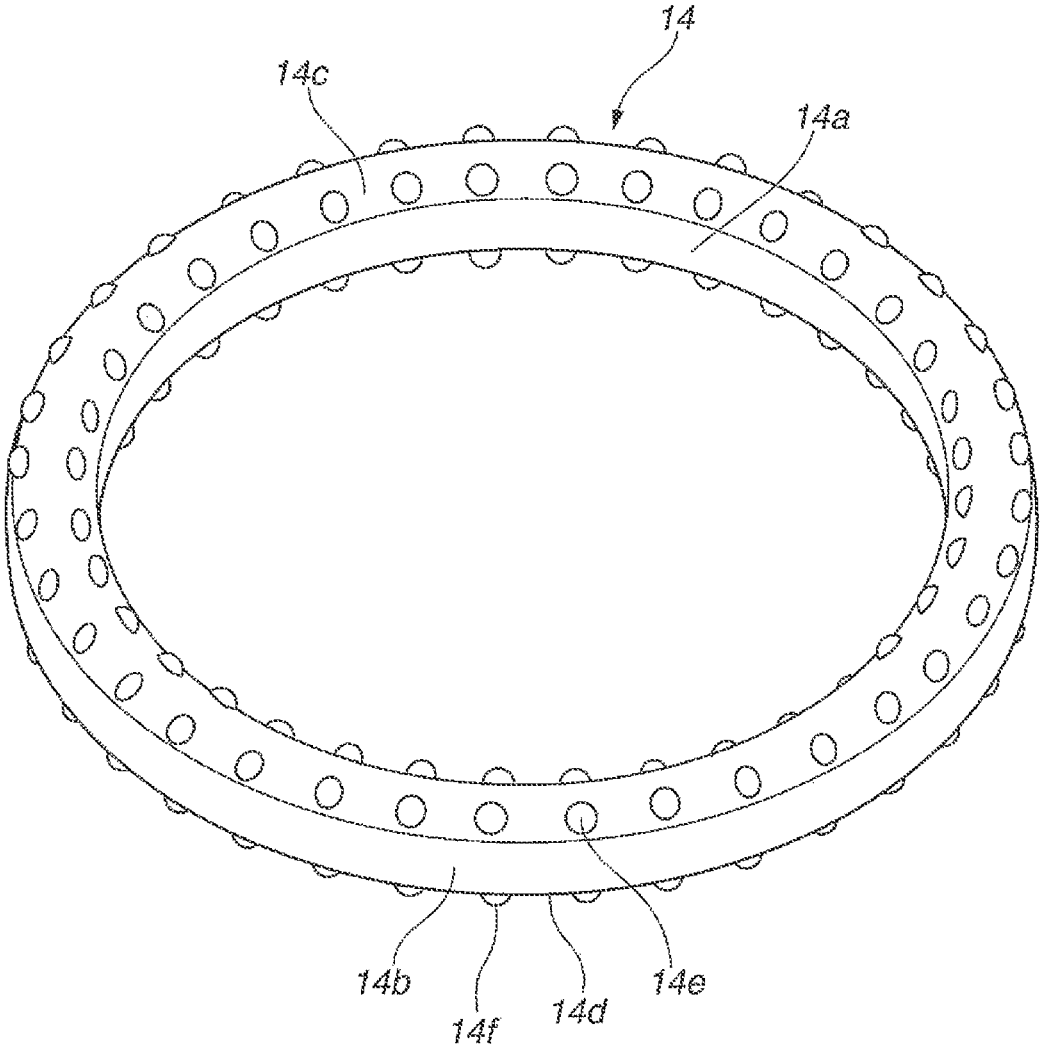
FIG. 6 is a perspective view of a soluble core used for forming the piston according to the first embodiment of the present invention.

Cooling channel 8 is formed using generally ring-shaped, soluble core 14 upon casting of piston 1. As shown in FIG. 6, soluble core 14 includes a pair of inner and outer peripheral side surfaces 14*a*, 14*b* which are opposed to each other in a radial direction of soluble core 14, and a pair of partly cylindrical upper and lower end surfaces 14*c*, 14*d* which are opposed to each other in a direction of a central axis of the ring shape of soluble core 14. A plurality of semispherical projections 14*e* are formed on inner and outer peripheral sides of upper end surface 14*c* in a substantially equidistantly spaced relation to each other in a circumferential direction of soluble core 14. Similarly, a plurality of semispherical projections 14*f* are formed on inner and outer peripheral sides of lower end surface 14*d* in a substantially equidistantly spaced relation to each other in a circumferential direction of soluble core 14. Semispherical projections 14*e*, 14*f* serve to form concave portions 8*e*, 8*f* of cooling channel 8. Soluble core 14 is formed by compressing and compacting a NaCl (sodium chloride) material into a ring shape by a forming die (not shown) by a compression press.

Upon casing of piston 1, a core unit is prepared by setting soluble core 14 on an upper portion of a metal core (not shown) that serves to form a shape of an inside surface of piston 1. The core unit is placed in a die (not shown), and then a molten aluminum alloy material is poured into the die to thereby form a workpiece for piston 1.

After that, the workpiece is withdrawn from the die, and soluble core 14 is dissolved by injecting water from a nozzle of a core dissolving jig (not shown) into introduction hole 9. The NaCl material of soluble core 14 dissolved is drained from drain hole 10 to an outside, so that cooling channel 8 having the same ring shape as that of soluble core 14 is formed. Thus, piston 1 having cooling channel 8 in thickened wall portion 3*a* is obtained.

[Functions and Effects of First Embodiment]

In piston 1 according to the first embodiment, during an operation of the internal combustion engine, a part of the lubricating oil O that lubricates sliding parts is injected from oil jet 11 toward cooling channel 8. The lubricating oil O injected is introduced into cooling channel 8 through introduction hole 9, and flows in cooling channel 8 and is discharged to the outside through drain hole 10. While flowing in cooling channel 8, the lubricating oil O absorbs heat generated in piston 1 and cools piston 1.

Further, when changeover of acceleration in the upward direction and acceleration in the downward direction occurs in accordance with shift of piston 1 between the upward movement, and the downward movement, there is caused interference of the lubricating oil O flowing in cooling channel 8. For instance, when an upward acceleration changes to a downward acceleration, a part of the lubricating oil O on the side of lower end surface 8*d* interferes with that on the side of upper end surface 8*c*. In contrast, when a downward acceleration changes to an upward acceleration, a part of the lubricating oil O on the side of upper end surface 8*c* interferes with that on the side of lower end surface 8*d*. Thus, the lubricating oil O is allowed to contact with the inner surface of cooling channel 8 to thereby absorb heat generated in piston 1 and cool piston 1.

Figures 7A, 7B, 7C:
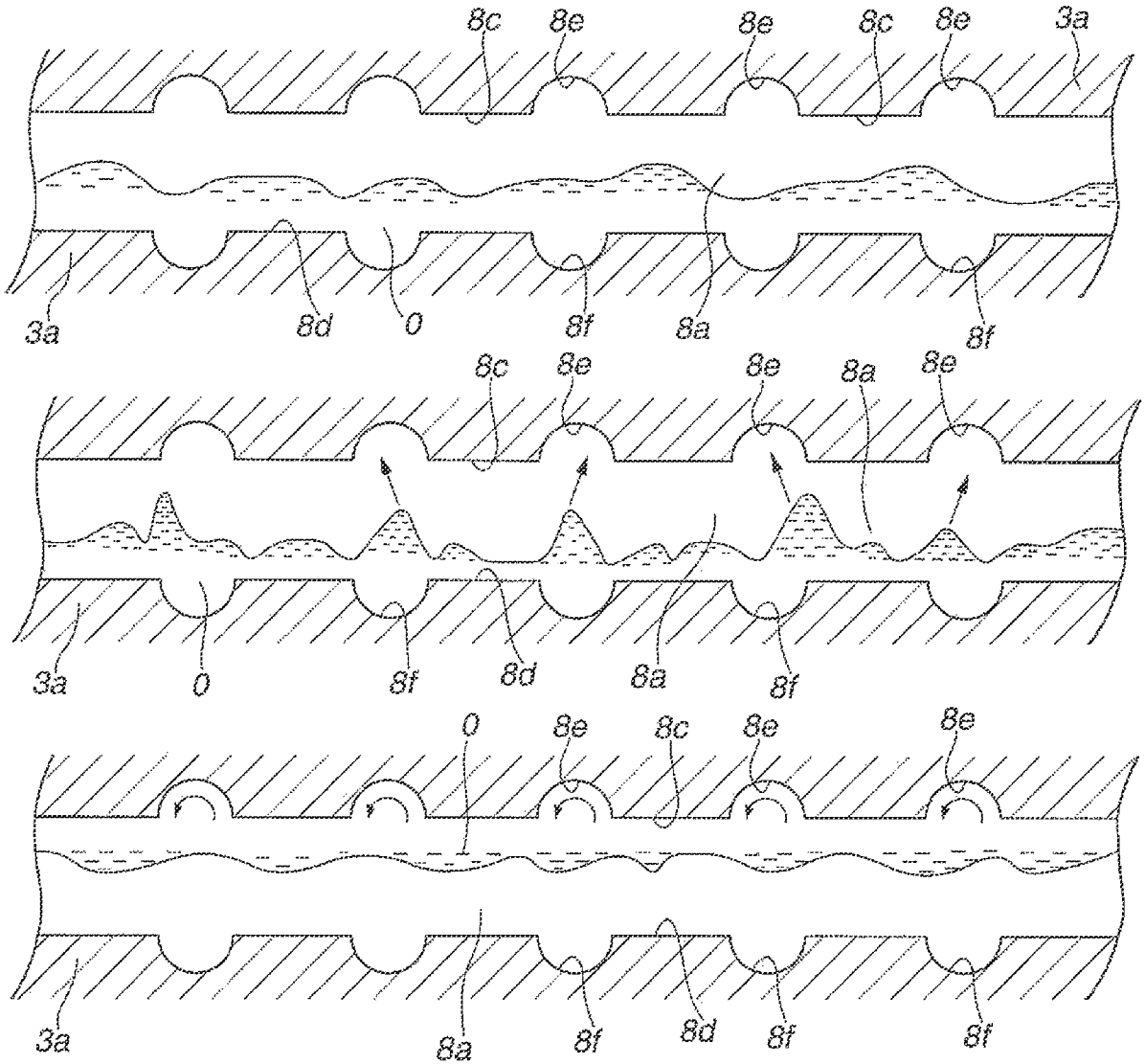
FIG. 7A to FIG. 7C are developed views of a cooling channel of the piston according to the first embodiment of the present invention, showing motions of a lubricating oil flowing in the cooling channel, in a condition of acceleration which the piston undergoes.
Figure 8A:
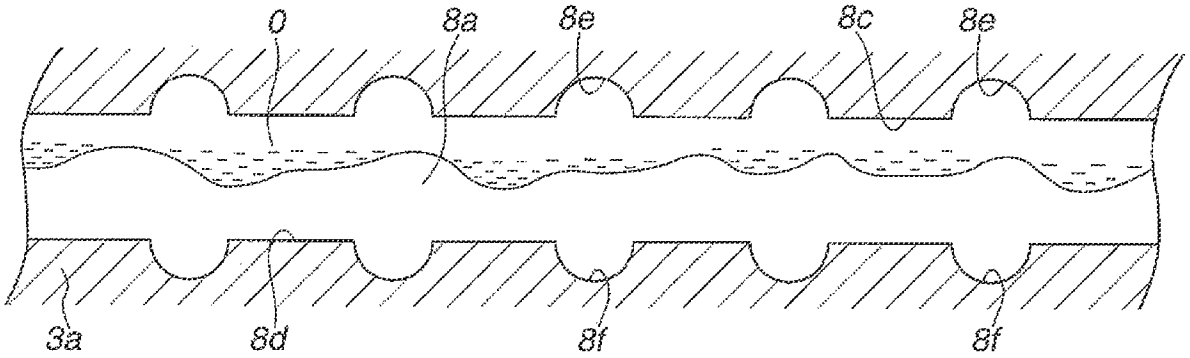
FIG. 8A to FIG. 8C are developed views of the cooling channel of the piston according to the first embodiment of the present invention, showing motions of a lubricating oil flowing in the cooling channel in accordance with a reciprocal movement of the piston in a condition of the acceleration which is different from the condition in FIG. 7A to FIG. 7C.
Figure 8B:
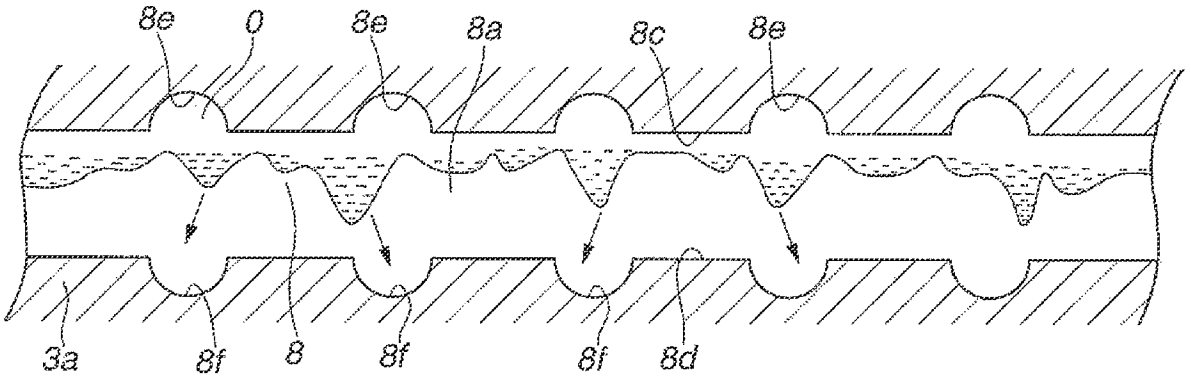
Figure 8C:
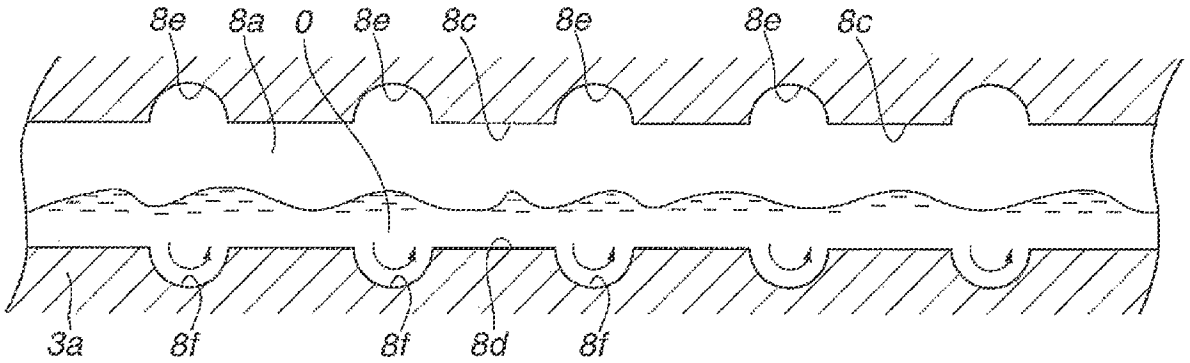

Particularly, in piston 1 according to the first embodiment, the plurality of semispherical concave portions 8*e* are formed in the inner and outer peripheral sides of upper end surface 8*c* of cooling channel 8, and the plurality of semispherical concave portions 8*f* are formed in the inner and outer peripheral sides of lower end surface 8*d* of cooling channel 8 so as to be opposed to semispherical concave portions 8*e* in the up-and-down direction (in the axial direction of piston 1). With this arrangement, when piston 1 undergoes an upward acceleration, the lubricating oil O flows from introduction hole 9 toward drain hole 10 along lower end surface 8*d* as shown in FIG. 7A. When piston 1 undergoes the downward acceleration changed from the upward acceleration, the lubricating oil O flowing along lower end surface 8*d* is caused to splash to contact with upper end surface 8*c* due to interference thereof as shown in FIG. 7B. Then, a part of the lubricating oil O thus splashed and contacted with upper end surface 8*c* flows and turns around along the semispherical surface of each of concave portions 8*e* as shown in FIG. 7C. On the other hand, when piston 1 undergoes a downward acceleration, the lubricating oil O flows from introduction hole 9 toward drain hole 10 along upper end surface 8*c* as shown in FIG. 8A. When piston 1 undergoes the upward acceleration changed from the downward acceleration, the lubricating oil O flowing along upper end surface 8*c* is caused to splash to contact with lower end surface 8*d* due to interference thereof as shown in FIG. 8B. Then, a part, of the lubricating oil O thus splashed and contacted with lower end surface 8*d* flows and turns around along the semispherical surface of each of concave portions 8*f* as shown in FIG. 8C. Owing to the turning flow of the lubricating oil O along the semispherical surfaces of concave portions 8*e*, 8*f*, an increase in flow rate of the lubricating oil O is caused to thereby enhance an efficiency of heat exchange between crown portion 3 and the lubricating oil O. As a result, cooling performance of piston 1 can be enhanced by cooling channel 8 with concave portions 8*e*, 8*f*.

Further, since the part of the lubricating oil O thus splashed and contacted with upper end surface 8*c* flows and turns around in multiple directions along the semispherical surface of each of concave portions 8*e* as shown in FIG. 7C, and a part of the lubricating oil O interfering with lower end surface 8*d* flows and turns around in multiple directions along the semispherical surface of each of concave portions 8*f* as shown in FIG. 8C, a contact area in which the lubricating oil O is contacted with the inner peripheral surface of cooling channel 8 is increased so that an effect of absorbing heat from piston 1 can be enhanced. Accordingly, cooling performance of piston 1 can be further enhanced by cooling channel 8 having concave portions 8*e*, 8*f*.

Further, concave portions 8*e*, 8*f* are arranged on the inner and outer peripheral sides of upper end surface 8*c* and the inner and outer peripheral sides of lower end surface 8*d*, respectively. With this arrangement, the turning flows of the lubricating oil O in concave portions 8*e*, 8*f* are generated during both the upward movement of piston 1 and the downward movement thereof. Therefore, cooling performance of piston 1 can be further enhanced.

Further, the plurality of concave portions 8*e* and the plurality of concave portions 8*f* are arranged in both the radial direction of cooling channel 8 and the circumferential direction thereof. With this arrangement, it is possible to increase portions of cooling channel 8 in which the lubricating oil O flows and turns around. As a result, a flow rate of the lubricating oil O can be increased to thereby enhance an efficiency of heat exchange at crown portion 3 and enhance cooling performance of piston 1.

Further, concave portions 8*e*, 8*f* are formed on the inner and outer peripheral sides of partly cylindrical upper end surface 8*c* and the inner and outer peripheral sides of partly cylindrical lower end surface 8*d*, respectively. Therefore, each of concave portions 8*e* is located in such a position as inclined toward an inside of cooling channel 8 with respect to a horizontal plane extending through the upper-most portion of cooling channel 8, and each of concave portions 8*f* is located in such a position as inclined toward the inside of cooling channel 8 with respect to a horizontal plane extending through the lower-most portion of cooling channel 8. With this arrangement, the depth of each of concave portions 8*e*, 8*f* can be set such that the distance between concave portions 8*e*, 8*f* opposed to each other in the up-and-down direction is substantially equal to the whole height of cooling channel 8. As a result, it is possible to enhance a freedom of layout of cooling channel 8.

Further, since soluble core 14 formed of the NaCl material is used, soluble core 14 can be dissolved with water to thereby facilitate the production of piston 1.

Further, soluble core 14 can be formed by compressing and compacting the NaCl material by a compression press, so that the forming work can be facilitated.

Second Embodiment

Figure 9:
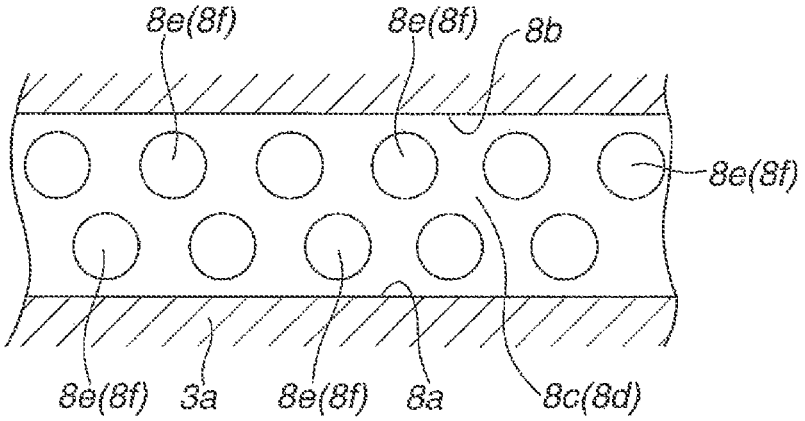
FIG. 9 is a developed view of a cooling channel of a piston according to a second embodiment of the present invention, showing upper and lower surfaces of the cooling channel.

FIG. 9 shows concave portions 8*e*, 8*f* respectively formed in upper and lower surfaces 8*c*, 8*d* of cooling channel 8 of a piston according to a second embodiment of the present invention. In the second embodiment, concave portions 8*e*, 8*f* formed on a side of inner peripheral side surface 8*a* of cooling channel 8 and concave portions 8*e*, 8*f* formed on a side of outer peripheral side surface 8*b* of cooling channel 8 are located offset relative to each other in the circumferential direction of cooling channel 8.

Specifically, concave portions 8*e* formed in upper end surface 8*c* on the side of inner peripheral side surface 8*a* (i.e., on the inner peripheral side of upper end surface 8*c*) and concave portions 8*e* formed in upper end surface 8*c* on the side of outer peripheral, side surface 8*b* (i.e., on the outer peripheral side of upper end surface 8*c*) are located offset relative to each other in the circumferential direction of cooling channel 8. Similarly, concave portions 8*f* formed in lower end surface 8*d* on the side of inner peripheral side surface 8*a* (i.e., on the inner peripheral side of lower end surface 8*d*) and concave portions 8*f* formed in lower end surface 8*d* on the side of outer peripheral, side surface 8*b* (i.e., on the outer peripheral side of lower end surface 8*d*) are located offset relative to each other in the circumferential direction of cooling channel 8.

Accordingly, concave portions 8*e* formed on the side of inner peripheral side surface 8*a* of upper end surface 8*c* and concave portions 8*e* formed on the side of outer peripheral side surface 8*b* of upper end surface 8*c* are located offset relative to each other in the circumferential direction of cooling channel 8. Similarly, concave portions 8*f* formed on the side of inner peripheral side surface 8*a* of lower end surface 8*d* and concave portions 8*f* formed on the side of outer peripheral side surface 8*b* of lower end surface 8*d* are located offset relative to each other in the circumferential direction of cooling channel 8. The lubricating oil O splashed out from each of concave portions 8*e* formed on the side of inner peripheral side surface 8*a* and the side of outer peripheral side surface 8*b* is contacted with the semispherical surface of each of the corresponding concave portions 8*f* opposed to the concave portions 8*e* in the up-and-down direction, and flows and turns around along the semispherical surface thereof. The flow rate of the lubricating oil O flowing in cooling channel 8 becomes higher than that in the first embodiment, so that an efficiency of heat exchange between crown portion 3 and the lubricating oil O can be further enhanced. As a result, the cooling performance of the piston with cooling channel 8 can be further enhanced than that in the first embodiment.

The piston of the second embodiment has the same construction as that of the first embodiment except for the above-described arrangement of concave portions 8*e*, 8*f*, and therefore, can attain the same effects as those of the first embodiment.

Third Embodiment

Figure 10:
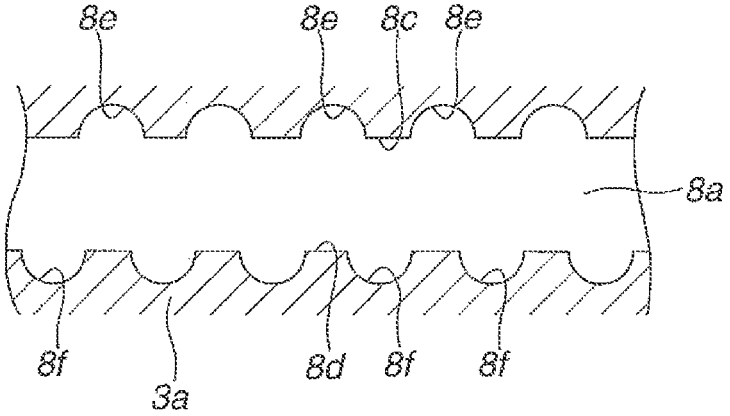
FIG. 10 is a developed view of a cooling channel of a piston according to a third embodiment of the present invention, showing a peripheral side surface of the cooling channel.

FIG. 10 shows concave portions 8*e*, 8*f* respectively formed in upper and lower surfaces 8*c*, 8*d* of cooling channel 8 of a piston according to a third embodiment of the present invention. In the third embodiment, concave portions 8*e* formed in upper surface 8*c* and concave portions 8*f* formed in lower surface 8*d* are located offset relative to each other in the circumferential direction of cooling channel 8. That is, concave portions 8*e* and concave portions 8*f* are also located offset relative to each other with a predetermined angle in the up-and-down direction.

With this offset arrangement of concave portions 8*e*, 8*f* in the third embodiment, the lubricating oil O splashed out from each of concave portions 8*e* is contacted with the semispherical surface of each of concave portions 8*f* offset relative to the concave portion 8*e* with the predetermined angle, and flows and turns around along the semispherical surface thereof. Accordingly, the flow rate of the lubricating oil O flowing in cooling channel 8 becomes higher than that in the first embodiment, so that an efficiency of heat exchange between crown portion 3 and the lubricating oil O can be further enhanced. As a result, the cooling performance of the piston with cooling channel 8 can be further enhanced than that in the first embodiment.

The piston of the third embodiment has the same construction as that of the first embodiment except for the above-described arrangement of concave portions 8*e*, 8*f*, and therefore, can attain the same effects as those of the first embodiment.

Fourth Embodiment

Figure 11:
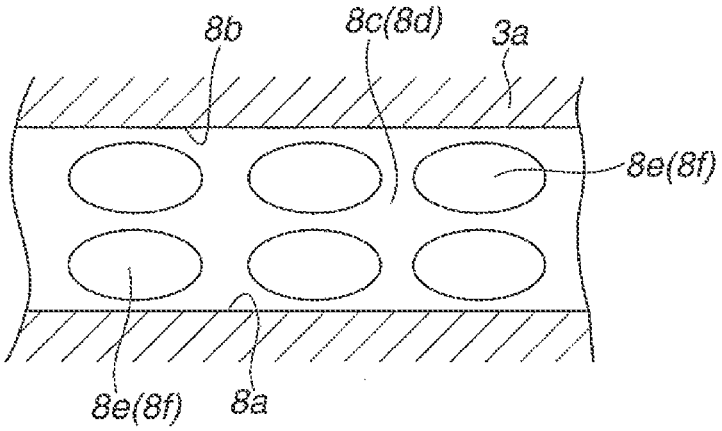
FIG. 11 is a developed view of a cooling channel of a piston according to a fourth embodiment of the present invention, showing upper and lower surfaces of the cooling channel.

FIG. 11 shows concave portions 8*e*, 8*f* respectively formed in upper and lower surfaces 8*c*, 8*d* of cooling channel 8 of a piston according to a fourth embodiment of the present invention. In the fourth embodiment, each of concave portions 8*e*, 8*f* has a shape different from that of each of concave portions 8*e*, 8*f* of the first embodiment. Specifically, each of concave portions 8*e*, 8*f* of the fourth embodiment has an oval shape as shown in FIG. 11 which has a major axis that extends along the circumferential direction of cooling channel 8.

The piston of the fourth embodiment has the same construction as that of the first embodiment except for the shape of each of concave portions 8*e*, 8*f*, and therefore, can attain the same effects as those of the first embodiment.

Fifth Embodiment

Figure 12:
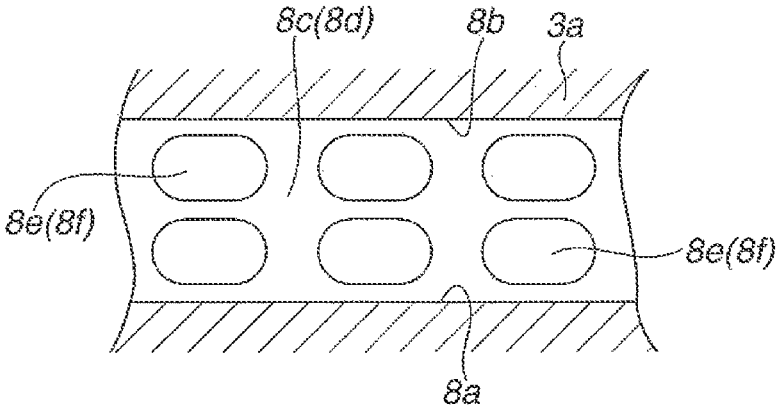
FIG. 12 is a developed view of a cooling channel of a piston according to a fifth embodiment of the present invention, showing upper and lower surfaces of the cooling channel.

FIG. 12 shows concave portions 8*e*, 8*f* respectively formed in upper and lower surfaces 8*c*, 8*d* of cooling channel 8 of a piston according to a fifth embodiment of the present invention. In the fifth embodiment, each of concave portions 8*e*, 8*f* has an oblong circle shape elongated in the circumferential direction of cooling channel 8.

The piston of the fifth embodiment has the same construction as that of the first embodiment except for the shape of each of concave portions 8*e*, 8*f*, and therefore, can attain the same effects as those of the first embodiment.

Sixth Embodiment

Figure 13:
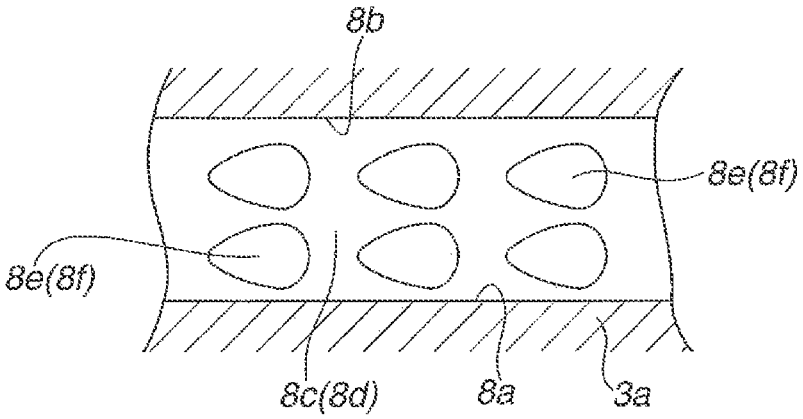
FIG. 13 is a developed view of a cooling channel of a piston according to a sixth embodiment of the present invention, showing upper and lower surfaces of the cooling channel.

FIG. 13 shows concave portions 8*e*, 8*f* respectively formed in upper and lower surfaces 8*c*, 8*d* of cooling channel 8 of a piston according to a sixth embodiment of the present invention. In the sixth embodiment, each of concave portions 8*e*, 8*f* has a teardrop shape tapered in one circumferential direction of cooling channel 8. Each of concave portions 8*e*, 8*f* may be formed into a teardrop shape tapered in a circumferential direction of cooling channel 8 opposite to the one circumferential direction thereof.

The piston of the sixth embodiment has the same construction as that of the first embodiment except for the shape of each of concave portions 8*e*, 8*f*, and therefore, can attain the same effects as those of the first embodiment.

Further, cooling channel 8 may be formed into a rectangular shape with rounded corners.

This application is based on a prior Japanese Patent Application No. 2013-59547 filed on Mar. 22, 2013, the entire contents of which is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A piston for an internal combustion engine, comprising:

a crown portion that defines a combustion chamber;

a ring-shaped cooling channel formed in the crown portion, through which a cooling oil flows; and a plurality of concave portions formed on at least one side of the cooling channel in an axial direction of the piston, each of the plurality of concave portions having a curved surface;

wherein each of the plurality of concave portions has a radial width smaller than a width of the cooling channel; and wherein each of the plurality of concave portions is positioned at a position apart from a radial center of the cooling channel in a radial direction.

2. The piston for an internal combustion engine as claimed in claim 1, wherein the plurality of concave portions are formed on both an inner peripheral side and an outer peripheral side of each of an upper end surface and a lower end surface of the cooling channel which are opposed to each other in a direction parallel to the axial direction of the piston.

3. The piston for an internal combustion engine as claimed in claim 2, wherein the plurality of concave portions are opposed to each other in the direction parallel to the axial direction of the piston.

4. The piston for an internal combustion engine as claimed in claim 1, wherein the plurality of concave portions are formed in an upper end surface and a lower end surface of the cooling channel which are opposed to each other in a direction parallel to the axial direction of the piston.

5. The piston for an internal combustion engine as claimed in claim 1, wherein the plurality of concave portions are formed in a radial direction of the cooling channel.

6. The piston for an internal combustion engine as claimed in claim 5, wherein the plurality of concave portions are substantially equidistantly spaced apart from each other in a circumferential direction of the cooling channel.

7. The piston for an internal combustion engine as claimed in claim 1, wherein the plurality of concave portions are formed in such a position as inclined with respect to a horizontal plane extending through an upper-most portion or a lower-most portion of the cooling channel.

8. The piston for an internal combustion engine as claimed in claim 1, wherein the ring shape of the cooling channel is partly interrupted in a circumferential direction thereof.

9. The piston for an internal combustion engine as claimed in claim 1, wherein the cooling channel has an oval shape in sectional view which has a major axis extending in a direction parallel to the axial direction of the piston.

10. The piston as claimed in claim 1, wherein the cooling channel has a rectangular shape with rounded corners.

11. The piston for an internal combustion engine as claimed in claim 1, wherein the piston is a cast piston made of an aluminum alloy material.

12. The piston for an internal combustion engine as claimed in claim 11, wherein the cooling channel is formed by dissolving a soluble core after casting the piston subsequent to setting the soluble core in a forming die.

13. The piston for an internal combustion engine as claimed in claim 12, wherein the soluble core is made of a sodium chloride material.

14. The piston as claimed in claim 13, wherein the soluble core is formed by a compression press.

15. A piston for an internal combustion engine, comprising:

a crown portion that defines a combustion chamber;

a ring-shaped cooling channel formed in the crown portion, through which a cooling oil flows; and a plurality of concave portions formed on at least one side of the cooling channel in an axial direction of the piston, each of the plurality of concave portions having a semi-spherical surface;

wherein each of the plurality of concave portions has a radial width smaller than a width of the cooling channel; and wherein each of the plurality of concave portions is positioned at a position apart from a radial center of the cooling channel in a radial direction.

16. A piston for an internal combustion engine, comprising:

a crown portion that defines a combustion chamber; and a ring-shaped cooling channel formed in the crown portion, through which a cooling oil flows, the cooling channel comprising a plurality of concave portions formed on at least one side in an axial direction of the piston;

wherein each of the plurality of concave portions has a concave shape configured such that the cooling oil is allowed to flow and turn around in multiple directions in the concave portion in accordance with an axial movement of the piston;

wherein each of the plurality of concave portions has a radial width smaller than a width of the cooling channel; and wherein each of the plurality of concave portions is positioned at a position apart from a radial center of the cooling channel in a radial direction.

17. The piston for an internal combustion engine as claimed in claim 16, wherein each of the plurality of concave portions has a rectangular shape with rounded corners.

18. The piston for an internal combustion engine as claimed in claim 16, wherein each of the plurality of concave portions has an oval shape.

19. The piston for an internal combustion engine as claimed in claim 18, wherein the oval shape of each of the plurality of concave portions has a major axis extending along a circumferential direction of the cooling channel.

* * * * *